US011551598B2

(12) United States Patent
Jang et al.

(10) Patent No.: US 11,551,598 B2
(45) Date of Patent: Jan. 10, 2023

(54) POWER SUPPLY AND DISPLAY APPARATUS INCLUDING THE SAME

(71) Applicant: LG Display Co., Ltd., Seoul (KR)

(72) Inventors: Won Yong Jang, Bucheon-si (KR); Hoon Jang, Goyang-si (KR); Soon Dong Cho, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/398,706

(22) Filed: Aug. 10, 2021

(65) Prior Publication Data

US 2022/0068179 A1 Mar. 3, 2022

(30) Foreign Application Priority Data

Aug. 26, 2020 (KR) ..... KR10-2020-0107653

(51) Int. Cl.
*G09G 3/20* (2006.01)

(52) U.S. Cl.
CPC ..... *G09G 3/20* (2013.01); *G09G 3/2096* (2013.01); *G09G 2310/0286* (2013.01); *G09G 2310/0289* (2013.01); *G09G 2310/08* (2013.01); *G09G 2330/04* (2013.01); *G09G 2330/045* (2013.01)

(58) Field of Classification Search
None
See application file for complete search history.

(56) References Cited

U.S. PATENT DOCUMENTS

| | | | | |
|---|---|---|---|---|
| 10,810,946 | B2 | 10/2020 | Han et al. | |
| 2004/0217931 | A1* | 11/2004 | Shin | G09G 3/3659 345/90 |
| 2013/0128395 | A1* | 5/2013 | Tsai | H02H 3/24 361/42 |
| 2015/0206499 | A1* | 7/2015 | Pyun | G09G 3/3611 345/212 |
| 2017/0316728 | A1* | 11/2017 | Lee | G09G 3/3266 |
| 2019/0027104 | A1* | 1/2019 | Zhang | G09G 3/20 |
| 2020/0020265 | A1* | 1/2020 | Lee | G09G 3/20 |
| 2020/0020280 | A1 | 1/2020 | Han et al. | |
| 2021/0183289 | A1* | 6/2021 | Kang | G09G 3/2092 |
| 2022/0068179 | A1* | 3/2022 | Jang | G09G 3/2096 |

FOREIGN PATENT DOCUMENTS

| | | | |
|---|---|---|---|
| KR | 10-2018-0036141 | A | 4/2018 |
| KR | 10-2018-0074896 | A | 7/2018 |
| KR | 10-2019-0140629 | A | 12/2019 |
| KR | 10-2020-0007317 | A | 1/2020 |

* cited by examiner

*Primary Examiner* — Dorothy Harris
(74) *Attorney, Agent, or Firm* — Fenwick & West LLP

(57) ABSTRACT

The present disclosure may provide a display apparatus including a display panel configured to display an image, a shift register configured to supply a scan signal to the display panel, a level shifter configured to output clock signals for driving the shift register, a power supply configured to supply a gate voltage to the level shifter, and a controller configured to sense a node voltage of a circuit generating the gate voltage, detect a short circuit between the clock signals based on a sensed value and an internal reference value, and control the power supply when the short circuit occurs between the clock signals.

13 Claims, 13 Drawing Sheets

POWER SUPPLY AND DISPLAY APPARATUS INCLUDING THE SAME

CROSS-REFERENCE TO RELATED APPLICATION

This application claims the benefit of Republic of Korea Patent Application No. 10-2020-0107653, filed on Aug. 26, 2020, which is hereby incorporated by reference in its entirety.

BACKGROUND

Field of the Technology

The present disclosure relates to a power supply and a display apparatus including the same.

Discussion of the Related Art

As information technology advances, the market for display apparatuses, which are connection mediums connecting a user to information, is growing. Therefore, the use of display apparatuses such as light emitting display apparatuses, quantum dot display (QDD) apparatuses, and liquid crystal display (LCD) apparatuses is increasing.

The display apparatuses described above include a display panel which includes a plurality of subpixels, a driver which outputs a driving signal for driving the display panel, and a power supply which supplies power to the display panel or the driver.

In such display apparatuses, when the driving signal (for example, a scan signal and a data signal) is supplied to each of the subpixels provided in the display panel, a selected subpixel may transmit light or may self-emit light, and thus, an image may be displayed.

SUMMARY

To overcome the aforementioned problem of the related art, the present disclosure may provide a power supply and a display apparatus including the same, which easily detect the occurrence or lack of occurrence of a short circuit between clock signals and stop an output of a voltage to reduce the damage of a circuit caused by an overcurrent. Also, the present disclosure determines the occurrence or lack of occurrence of a short circuit between clock signals without an abnormal operation, thereby enhancing the reliability and stability of an apparatus.

To achieve these objects and other advantages and in accordance with the purpose of the disclosure, as embodied and broadly described herein, a display apparatus including a display panel configured to display an image, a shift register configured to supply a scan signal to the display panel, a level shifter configured to output clock signals for driving the shift register, a power supply configured to supply a gate voltage to the level shifter, and a controller configured to sense a node voltage of a circuit generating the gate voltage, detect a short circuit between the clock signals based on a sensed value and an internal reference value, and control the power supply when the short circuit occurs between the clock signals.

The power supply may stop an output of the gate voltage when the short occurs between the clock signals.

The controller may perform a logic operation on a first result value, generated by comparing the sensed value with the internal reference value, and a second result value generated through a count operation of an internal counter to generate a sensing result value and may monitor the sensing result value for a certain time to determine whether or not the short circuit occurs between the clock signals.

The controller may include a comparator including a first terminal, connected to a node of a circuit generating the gate voltage in the power supply, and a second terminal connected to a reference voltage terminal providing the internal reference value, an AND gate including a first input terminal, connected to an output terminal of the comparator, and a second input terminal connected to an output terminal of an internal counter, and an overcurrent protector connected to an output terminal of the AND gate to determine whether or not the short circuit occurs between the clock signals while monitoring a sensing result value output from the AND gate for a certain time, and when the short circuit is determined, to output a stop signal for stopping an output of the power supply.

The level shifter may operate based on an off clock signal and an on clock signal each output from the timing controller to output the clock signals, and the controller may perform a logic operation on a first result value, generated by comparing the sensed value with the internal reference value, and a second result value generated based on the off clock signal and the on clock signal to generate a sensing result value and may monitor the sensing result value for a certain time to determine whether or not the short circuit occurs between the clock signals.

The controller may include a comparator including a first terminal, connected to a node of a circuit generating the gate voltage in the power supply, and a second terminal connected to a reference voltage terminal providing the internal reference value, an OR gate including a first input terminal, connected to an off clock signal line for controlling the level shifter, and a second input terminal connected to an on clock signal line for controlling the level shifter, an AND gate including a first input terminal, connected to an output terminal of the comparator, and a second input terminal connected to an output terminal of the OR gate, and an overcurrent protector connected to an output terminal of the AND gate to determine whether or not the short circuit occurs between the clock signals while monitoring a sensing result value output from the AND gate for a certain time, and when the short circuit is determined, to output a stop signal for stopping an output of the power supply.

The overcurrent protector may monitor a sensing result value output from the AND gate for a certain time, and when a specific logic signal is continuously generated, the overcurrent protector may determine the short circuit between the clock signals.

In another aspect of the present disclosure, a display apparatus includes a display panel configured to display an image, a shift register configured to supply a scan signal to the display panel, a level shifter configured to output clock signals for driving the shift register, a power supply configured to supply a gate voltage to the level shifter, and a controller configured to stops an output of the power supply when a specific logic signal is continuously generated "N" or more times (where N is an integer of 2 or more) in a short circuit occurs between the clock signals.

The controller may sense a node voltage of a circuit generating the gate voltage in the power supply and may perform an arithmetic operation of detecting whether or not the short circuit occurs between the clock signals on the basis of a sensed value and an internal reference value, and when the specific logic signal is continuously generated "N"

or more times (where N is an integer of 2 or more), the controller may stop an output of the power supply.

When the short circuit between the clock signals is determined by the controller, the power supply may stop the output of the power supply.

In another aspect of the present disclosure, a power supply includes a level shifter, when a specific logic signal is continuously generated "N" or more times (where N is an integer of 2 or more) in a circuit provided therein due to a short circuit between clock signals, the level shifter configured to determine the short circuit occurs between the clock signals and output a stop signal and a voltage generator configured to stops a switching operation of generating a gate voltage on the basis of the stop signal output from the level shifter.

The level shifter may include a controller configured to sense a node voltage of a circuit generating the gate voltage in the voltage generator and perform an arithmetic operation of detecting whether or not the short circuit occurs between the clock signals on the basis of a sensed value and an internal reference value, and when the specific logic signal is continuously generated "N" or more times (where N is an integer of 2 or more), determine the short circuit between the clock signals.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Hereinafter, the present disclosure will be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

A display apparatus according to the present disclosure may be applied to televisions (TVs), video players, personal computers (PCs), home theaters, electronic devices for vehicles, and smartphones, but is not limited thereto. The display apparatus according to the present disclosure may be implemented as a light emitting display apparatus, a quantum dot display (QDD) apparatus, a liquid crystal display (LCD) apparatus, or the like. Hereinafter, however, for convenience of description, a light emitting display apparatus which self-emits light on the basis of an inorganic light emitting diode or an organic light emitting diode will be described for example.

Moreover, an example where a scan driver described below includes a p-type thin film transistor (TFT) will be described, but is not limited thereto and the scan driver may be implemented with an n-type TFT or with an n-type TFT and a p-type TFT. A TFT may be a three-electrode element including a gate, a source, and a drain. The source may be an electrode which provides a carrier to a transistor. In the TFT, a carrier may start to flow from the source. The drain may be an electrode where the carrier flows from the TFT to the outside. That is, in the TFT, the carrier flows from the source to the drain.

In the p-type TFT, because a carrier is a hole, a source voltage may be higher than a drain voltage so that the hole flows from the source to the drain. In the p-type TFT, because the hole flows from the source to the drain, a current may flow from the source to the drain. On the other hand, in the n-type TFT, because a carrier is an electron, a source voltage may have a lower voltage than a drain voltage so that the electron flows from the source to the drain. In the n-type TFT, because the electron flows from the source to the drain, a current may flow from the drain to the source. However, a source and a drain of a TFT may switch therebetween on the basis of a voltage applied thereto. Based thereon, in the following description, one of a source and a drain will be described as a first electrode, and the other of the source and the drain will be described as a second electrode.

Figure 1:
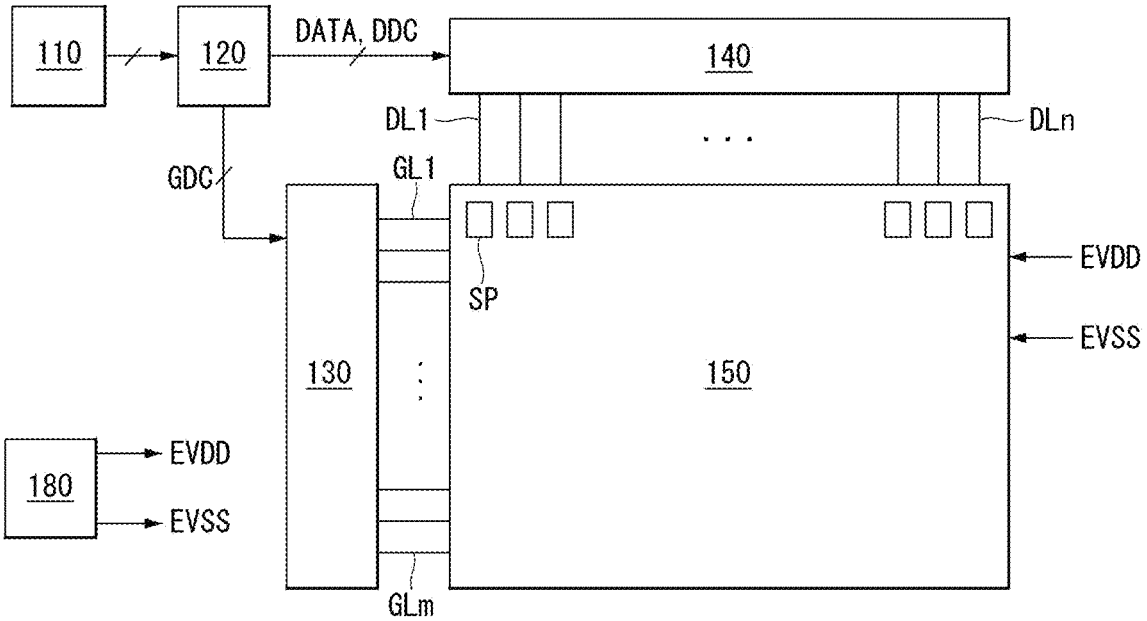
FIG. 1 is a block diagram schematically illustrating a light emitting display apparatus according to a first embodiment of the present disclosure.
Figure 2:
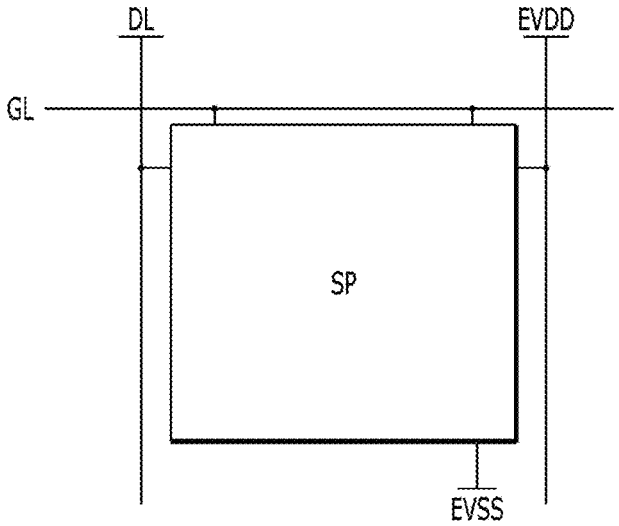
FIG. 2 is a configuration diagram schematically illustrating a subpixel illustrated in FIG. 1 according to one embodiment.

FIG. 1 is a block diagram schematically illustrating a first light emitting display apparatus according to an embodiment of the present disclosure, and FIG. 2 is a configuration diagram schematically illustrating a subpixel illustrated in FIG. 1 according to one embodiment.

As illustrated in FIGS. 1 and 2, the light emitting display apparatus according to the first embodiment of the present disclosure may include a video supply unit 110, a timing controller 120, a scan driver 130, a data driver 140, a display panel 150, and a power supply 180.

The video supply unit 110 (or a host system) may output a video data signal supplied from the outside or a video data signal and various driving signals stored in an internal memory thereof. The video supply unit 110 may supply a data signal and the various driving signals to the timing controller 120.

The timing controller 120 may output a gate timing control signal GDC for controlling an operation timing of the scan driver 130, a data timing control signal DDC for controlling an operation timing of the data driver 140, and various synchronization signals (for example, a vertical synchronization signal Vsync and a horizontal synchronization signal Hsync). The timing controller 120 may provide the data driver 140 with the data timing control signal DDC and a data signal DATA supplied from the video supply unit 110. The timing controller 120 may be implemented as an integrated circuit (IC) type and may be mounted on a printed circuit board (PCB), but is not limited thereto.

The scan driver 130 may output a scan signal (or a scan voltage) in response to the gate timing control signal GDC supplied from the timing controller 120. The scan driver 130 may supply the scan signal to a plurality of subpixels, included in the display panel 150, through a plurality of scan lines GL1 to GLm. The scan driver 130 may be implemented as an IC type or may be directly provided on the display panel 150 in a gate-in panel (GIP) type, but is not limited thereto.

In response to the data timing control signal DDC supplied from the timing controller 120, the data driver 140 may sample and latch the data signal DATA, convert a digital data signal into an analog data voltage on the basis of a gamma reference voltage, and output the analog data voltage. The data driver 140 may respectively supply data voltages to the subpixels of the display panel 150 through a plurality of data lines DL1 to DLn. The data driver 140 may be implemented as an IC type or may be mounted on the display panel 150 or a PCB, but is not limited thereto.

The power supply 180 may generate and output a first panel power EVDD having a high level and a second panel power EVSS having a low level that is less than the high level on the basis of an external input voltage supplied from the outside. The power supply unit 180 may generate and output a voltage (for example, a scan high voltage and a scan low voltage) needed for driving of the scan driver 130 or a voltage (for example, a drain voltage and a half drain voltage) needed for driving of the data driver 140, in addition to the first panel power EVDD and the second panel power EVSS.

The display panel 150 may display an image on the basis of a driving signal including the scan signal and a data voltage, the first panel power EVDD, and the second panel power EVSS. The subpixels of the display panel 150 may each self-emit light. The display panel 150 may be manufactured based on a substrate, having stiffness or flexibility, such as glass, silicon, or polyimide. Also, the subpixels emitting light may include pixels including red, green, and blue, or may include pixels including red, green, blue, and white.

For example, one subpixel SP may include a pixel circuit which includes a switching transistor, a driving transistor, a storage capacitor, and an organic light emitting diode. The subpixel SP applied to the light emitting display apparatus may self-emit light, and thus, may be complicated in circuit configuration. Also, the subpixel SP may further include various circuits such as a compensation circuit which compensates for a degradation in the organic light emitting diode emitting light and a degradation in the driving transistor supplying a driving current to the organic light emitting diode. Accordingly, it may be assumed that the subpixel SP is simply illustrated in a block form.

Hereinabove, each of the timing controller 120, the scan driver 130, and the data driver 140 has been described as an individual element. However, based on an implementation type of the light emitting display apparatus, one or more of the timing controller 120, the scan driver 130, and the data driver 140 may be integrated into one IC.

Figure 3A:
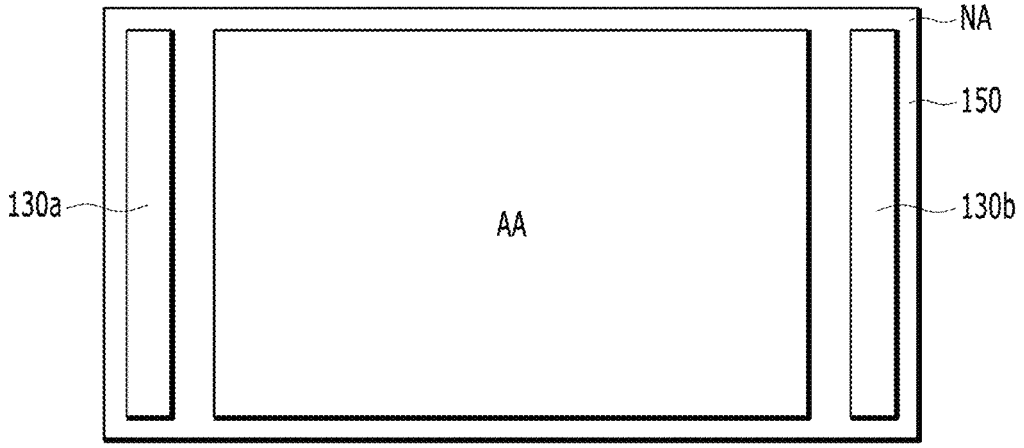
FIGS. 3A and 3B are diagrams illustrating arrangement examples of a gate-in panel (GIP) type scan driver according to one embodiment.
Figure 3B:
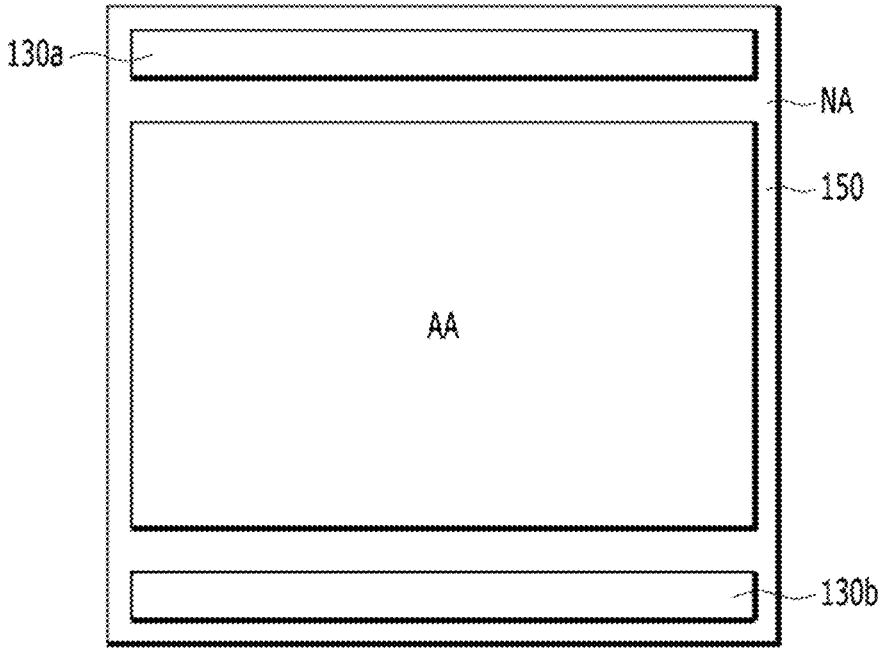
Figure 4:
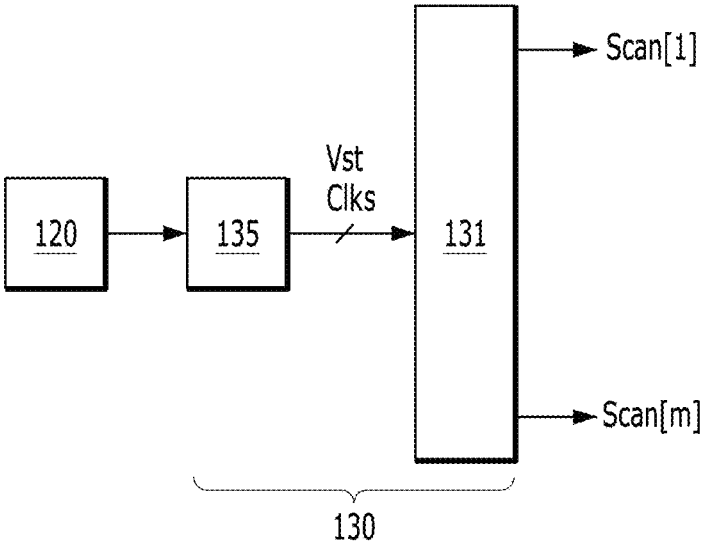
FIGS. 4 and 5 are exemplary diagrams illustrating a configuration of an apparatus associated with the GIP type scan driver according to one embodiment.
Figure 5:
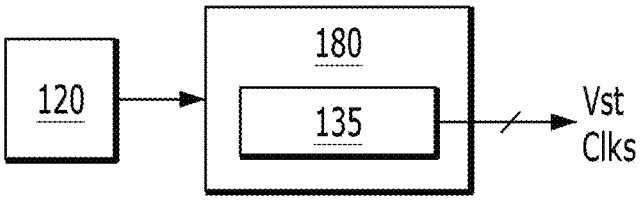
Figure 6:
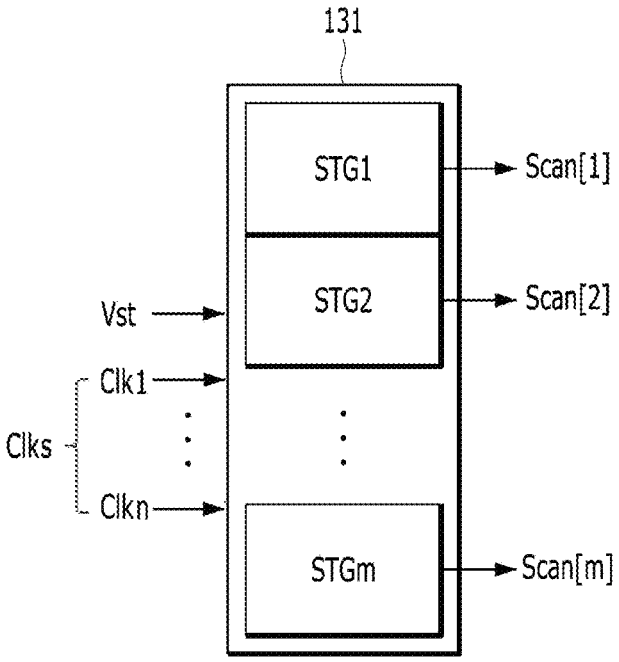
FIG. 6 is a diagram illustrating a stage of a shift register according to one embodiment.

FIGS. 3A and 3B are diagrams illustrating arrangement examples of a GIP type scan driver, FIGS. 4 and 5 are exemplary diagrams illustrating a configuration of an apparatus associated with the GIP type scan driver, and FIG. 6 is a diagram illustrating a stage of a shift register.

As illustrated in FIGS. 3A and 3B, a plurality of GIP type scan drivers 130*a* and 130*b* may be disposed in a non-display area NA of a display panel 150. The scan drivers 130*a* and 130*b*, as illustrated in FIG. 3A, may be respectively disposed in a left non-display area NA and a right non-display area NA of the display panel 150. Also, as illustrated in FIG. 3B, the scan drivers 130*a* and 130*b* may be respectively disposed in an upper non-display area NA and a lower non-display area NA of the display panel 150.

An example is illustrated and described where the scan drivers 130*a* and 130*b* are disposed in the non-display area NA disposed at left and right sides or upper and lower sides of a display area AA, but the present disclosure is not limited thereto and the scan drivers 130*a* and 130*b* may be disposed at only one of a left side, a right side, an upper side, or a lower side.

As illustrated in FIG. 4, a GIP type scan driver 130 may include a shift register 131 and a level shifter 135. The level shifter 135 may generate and output one or more of a clock signal Clk and a start signal Vst on the basis of signals output from the timing controller 120. The clock signal Clk may be generated and output in a K-phase (where K is an integer of 2 or more) form where phases such as two phases, four phases, and eight phases differ.

The shift register 131 may operate based on the signals Clk and Vst output from the level shifter 135 and may output scan signals Scan[1] to Scan[m] for turning on or off transistors provided in a display panel. The shift register 131 may be implemented as a thin film type in the display panel on the basis of the GIP type. Accordingly, a portion, provided in the display panel, of the scan driver 130 may be the shift register 131. Also, 130*a* and 130*b* in FIG. 3 may correspond to 131.

As illustrated in FIGS. 4 and 5, unlike the shift register 131, the level shifter 135 may be implemented as an IC type, or may be included in the power supply 180. However, this is merely an embodiment, and the present disclosure is not limited thereto.

As illustrated in FIG. 6, the shift register 131 may include a plurality of stages (for example, first to $M^{th}$ stages) STG1 to STGm. The plurality of stages STG1 to STGm may operate based on signals Clk and Vst output from the level shifter 135 and may have a cascade connection relationship for sequentially outputting the scan signals Scan[1] to Scan [m] up to the $M^{th}$ stage STGm from the first stage STG1. For example, an output terminal or a carry terminal of the first stage STG1 may be connected to a start signal line which is an input terminal of the second stage STG2, and an output terminal or a carry terminal of the second stage STG2 may be connected to a start signal line which is an input terminal of the third stage STG3.

In FIG. 6, an example is illustrated and described where the stages STG1 to STGm included in the shift register 131 output first to $M^{th}$ scan signals Scan[1] to Scan[m] in order. However, the stages STG1 to STGm included in the shift register 131 may output the first to $M^{th}$ scan signals Scan[1] to Scan[m] in order, in reverse order, or randomly on the basis of a control manner.

Figure 7:
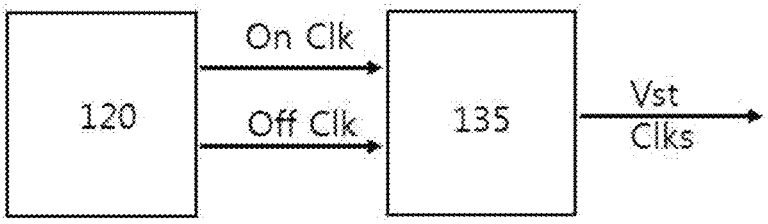
FIGS. 7 and 8 are block diagrams for describing the light emitting display apparatus according to the first embodiment of the present disclosure.
Figure 8:
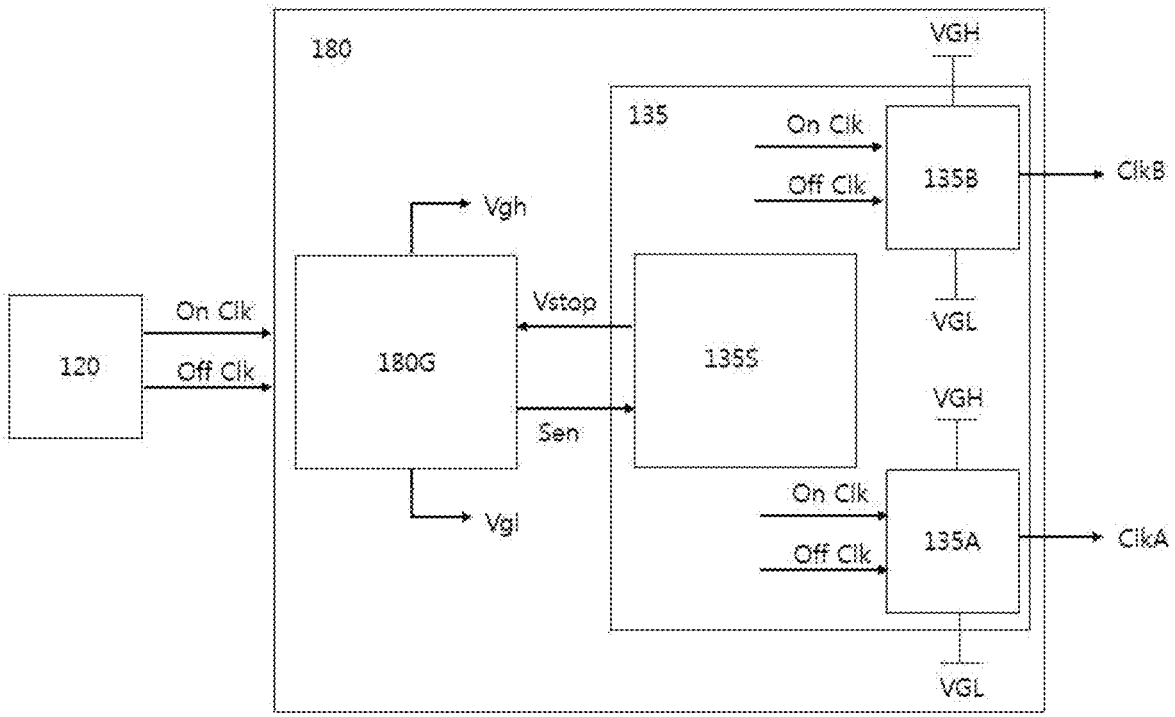
Figure 9:
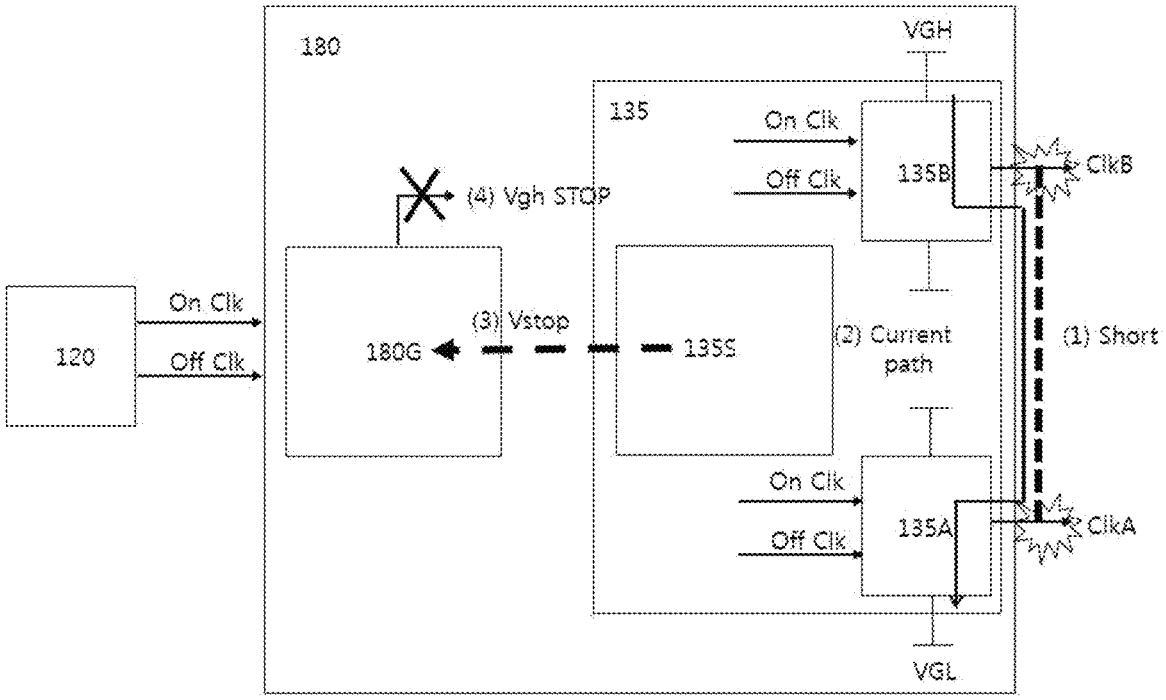
FIGS. 9 to 11 are diagrams for describing a short circuit detection function of the light emitting display apparatus according to the first embodiment of the present disclosure.
Figure 10:
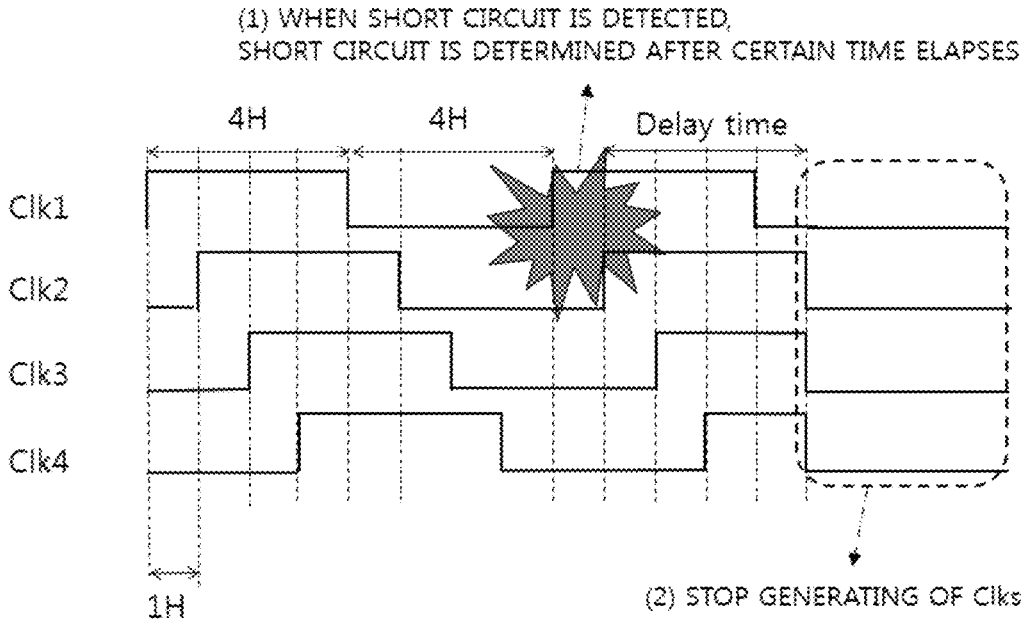
Figure 11:
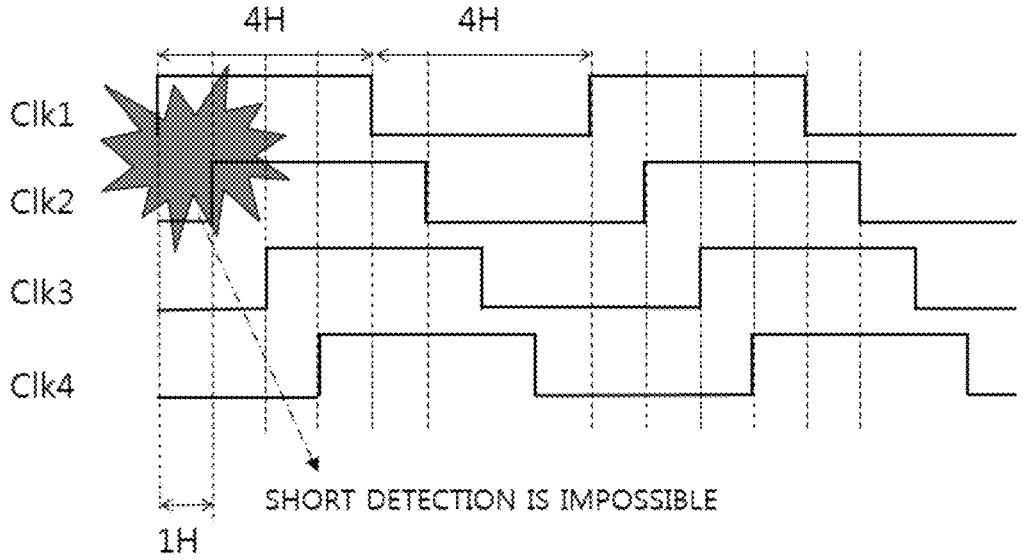

FIGS. 7 and 8 are block diagrams for describing the light emitting display apparatus according to the first embodiment of the present disclosure, and FIGS. 9 to 11 are diagrams for describing a short circuit detection function of the light emitting display apparatus according to the first embodiment of the present disclosure.

As illustrated in FIGS. 7 and 8, the level shifter 135 may operate based on an on clock signal (On Clk) and an off clock signal (Off Clk) each output from the timing controller 120 and may output signals Clk and Vst needed for operations of a plurality of stages. As described above, the level shifter 135 may be implemented as an independent IC type, but in the following description, for convenience of description, an example where the level shifter 135 is included in a power supply will be described.

As illustrated in FIG. 8, a power supply 180 may include a voltage generator 180G, which generates and outputs a gate voltage including a gate high voltage Vgh and a gate low voltage Vgl, and a level shifter 135 which generates and outputs a first clock signal ClkA and a second clock signal ClkB.

The voltage generator 180G may generate and output the gate voltage including the gate high voltage Vgh and the gate low voltage Vgl, which are to be supplied to the level shifter 135, on the basis of a voltage supplied from the outside.

The level shifter 135 may include a first clock signal generator 135A, a second clock signal generator 135B, and a clock signal controller 135S. The first clock signal generator 135A and the second clock signal generator 135B may operate based on the on clock signal (On Clk) and the off clock signal (Off Clk) each output from a timing controller 120 and may output a first clock signal and a second clock signal including a logic high level and a logic low level as a level of a gate high voltage Vgh and a level of a gate low voltage Vgl.

The clock signal controller 135S may control the first clock signal generator 135A and the second clock signal generator 135B. Also, the clock signal controller 135S may sense a node voltage for generating the gate high voltage Vgh in the voltage generator 180G and may perform an arithmetic operation of detecting the occurrence or not of short circuit between clock signals on the basis of a sensing voltage and an internal reference value, and when short circuit is determined, the clock signal controller 135S may output a signal Vstop for controlling the voltage generator 180G. The clock signal controller 1355 may sense a node voltage of a circuit for generating the gate low voltage Vgl, in order to detect the occurrence or not of short circuit.

A short circuit between clock signals may occur due to various causes such as a circuit defect (a defect of an IC), the occurrence of particles (short circuit caused by particles between thin films configuring clock lines) in a manufacturing process or a problem (a crack of a display panel) of an assembly process, and a process of packaging, moving, or installing an apparatus. Also, a short circuit may occur at various points (regions). Hereinafter, therefore, in order to help understanding, a short circuit caused by a connection between output terminals of clock signal generators will be described for example.

As illustrated in FIG. 9, when a short circuit between a first clock signal and a second clock signal occurs, a connection short circuit such as "(1) short" may occur between an output terminal of the first clock signal generator 135A and an output terminal of the second clock signal generator 135B.

When short circuit occurs between the output terminal of the first clock signal generator 135A and the output terminal of the second clock signal generator 135B, a current path such as "(2) current path" may be formed between the first clock signal generator 135A and the second clock signal generator 135B. When the current path such as "(2) current path" is formed, the gate high voltage Vgh output from the voltage generator 180G may drop to the gate low voltage Vgl or may decrease to a low voltage level such as a ground level. (i.e., an abnormal output occurs)

As described above, when short circuit occurs, the clock signal controller 135S may output a signal for controlling the voltage generator 180G like "(3) Vstop". The voltage generator 180G which has received a signal such as "(3) Vstop" from the clock signal controller 135S may stop an output of the gate high voltage Vgh like "(4) Vgh STOP".

The voltage generator 180G may generate and output voltages for driving a data driver and a display panel, in addition to the gate high voltage Vgh and the gate low voltage Vgl. Also, an example is described where the level shifter 135 generates a two-phase clock signal including the first clock signal ClkA and the second clock signal ClkB, but the level shifter 135 may generate and output a clock signal having four phases, eight phases, or the like. For example, in a case where the level shifter 135 generates a four-phase clock signal, the clock signal generator may include a total of four clock signal generators (e.g., first to fourth clock signal generators), and in a case where the level shifter 135 generates an eight-phase clock signal, the clock signal generator may include a total of eight clock signal generators (e.g., first to eighth clock signal generators).

The clock signal controller 135S may provide a result value on the basis of an internal reference voltage and a voltage sensed from the voltage generator 180G and may count a voltage or a signal along with the result value or may provide a sensing result value as an additionally calculated value, and based on thereon, the clock signal controller 135S may determine the occurrence or not of short circuit. When a criterion for determining the occurrence or lack of occurrence of a short circuit is provided based on a method of counting or calculating a voltage or a signal, the occurrence or lack of occurrence of a short circuit between clock signals (for example, clock signals a logic high period of a preceding clock signal partially overlaps a logic high period of a succeeding clock signal) overlapping one another for a relatively short time may be easily detected.

Hereinafter, a method of determining a short circuit according to an embodiment will be described based on first to fourth clock signals Clk1 to Clk4 having a total of four phases, in which a logic high level and a logic low level are generated at a four-horizontal time period H and a logic high level generating period is apart from a next logic high level generating period by a one-horizontal time.

As in FIG. 10 (1), when short circuit between the first clock signal Clk1 and the second clock signal Clk2 is detected, a short circuit may not be immediately determined, and after a certain time elapses, the occurrence of short circuit may be determined. Also, as in FIG. 10 (2), when the determination of short circuit is completed, the generating of the clock signals Clks may stop.

As in FIG. 11, in the clock signals Clk1 to Clk4, a period at which a logic high level is generated may be relatively short, and thus, a period where short circuit occurs may be short. Therefore, it may be unable to detect short circuit by using a simple short circuit detecting method. As a result, by using a method of detecting the continuous occurrence or lack of occurrence of a specific logic signal while monitoring a voltage or a signal for a certain time, whether a short circuit is a short circuit caused by a temporary abnormal operation or a real short circuit caused by a manufacturing process, an assembly process, or a circuit defect may be accurately determined.

Figure 12:
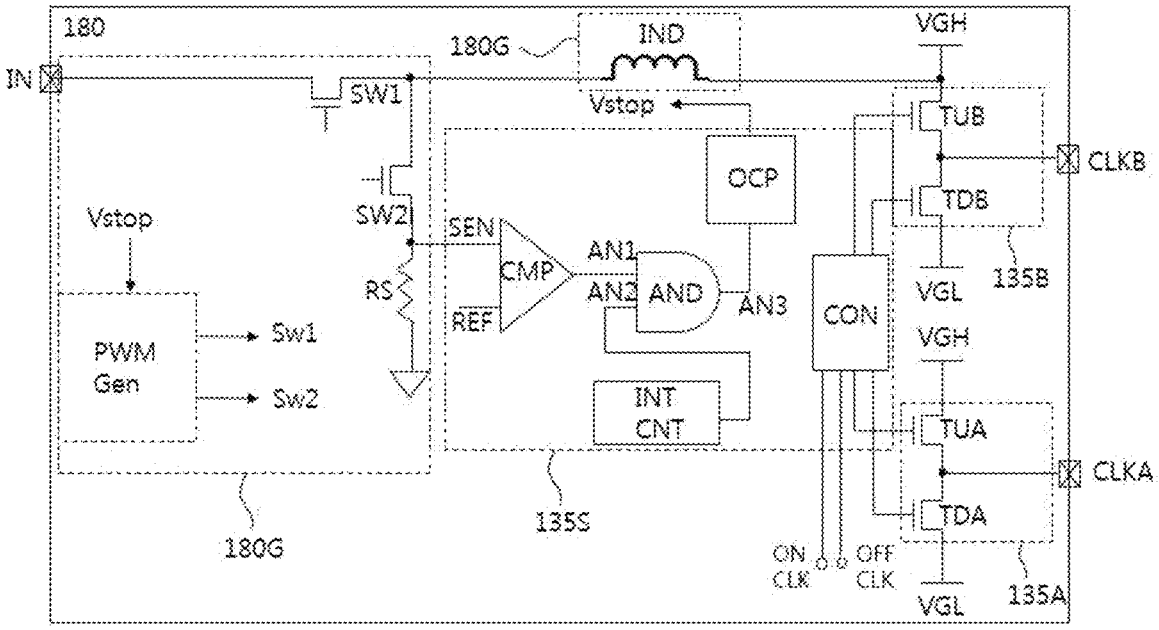
FIG. 12 is a circuit diagram for describing a light emitting display apparatus according to a second embodiment of the present disclosure.
Figure 13:
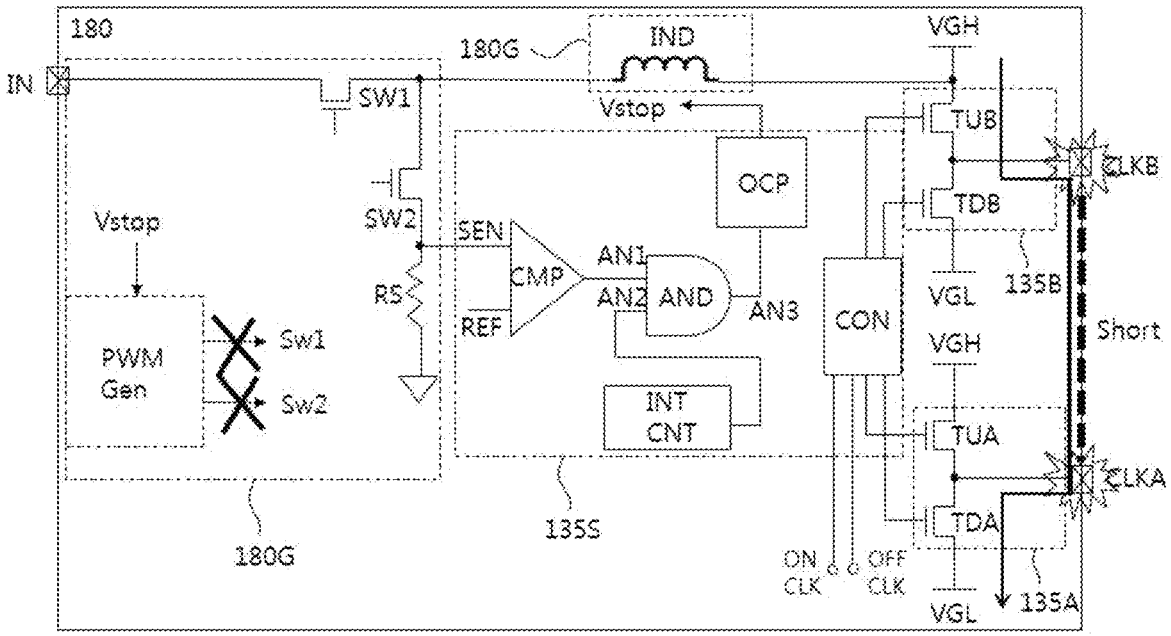
FIGS. 13, 14, 15A, and 15B are diagrams for describing a short circuit detection function of the light emitting display apparatus according to the second embodiment of the present disclosure.
Figure 14:
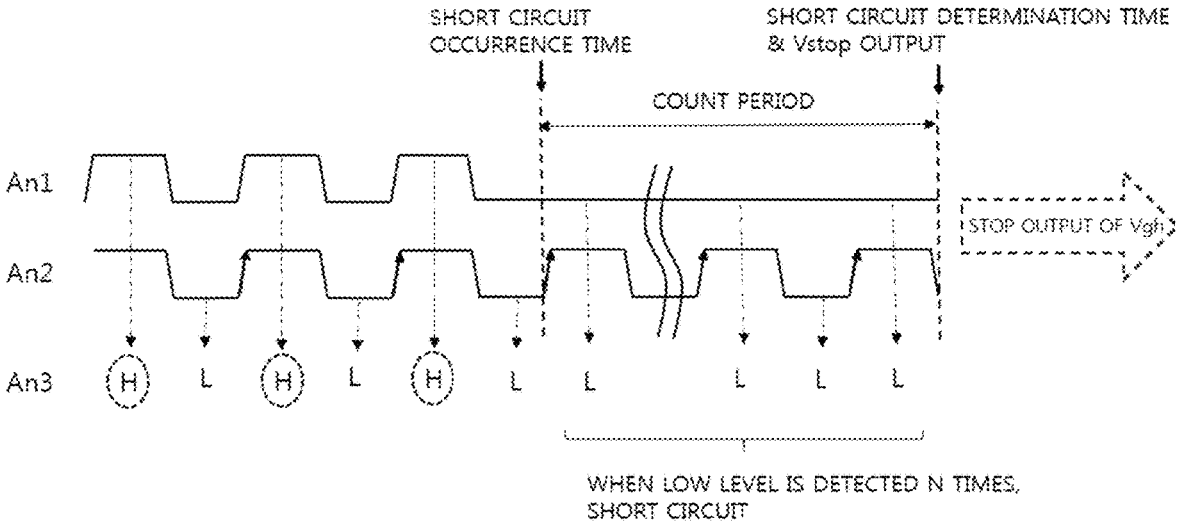

FIG. 12 is a circuit diagram for describing a light emitting display apparatus according to a second embodiment of the present disclosure, and FIGS. 13 to 15 are diagrams for describing a short circuit detection function of the light emitting display apparatus according to the second embodiment of the present disclosure.

As illustrated in FIG. 12, a voltage generator 180G may generate and output a gate high voltage Vgh and a gate low voltage Vgl which are to be supplied to a level shifter 135, on the basis of a voltage supplied from the outside.

To this end, the voltage generator 180G may include a first switch SW1, a second switch SW2, a resistor RS, an inductor IND, and a signal generator (PWM Gen).

The signal generator (PWM Gen) may generate and output a first switch signal Sw1 and a second switch signal Sw2, which control a turn-on/off time of the first switch SW1 and the second switch SW2 for generating the gate high voltage Vgh on the basis of an external voltage input through an input terminal IN. The first switch SW1 and the second switch SW2 may perform a turn-on/off operation on the basis of the first switch signal Sw1 and the second switch signal Sw2. The inductor IND may charge or discharge energy and may generate and output the gate high voltage Vgh, on the basis of the first switch SW1 and the second switch SW2.

The level shifter 135 may include a first clock signal generator 135A, a second clock signal generator 135B, and a clock signal controller 135S.

The clock signal controller 135S may control the first clock signal generator 135A and the second clock signal generator 135B. Also, the clock signal controller 135S may sense a node voltage of the voltage generator 180G, and when short circuit between clock signals occurs, the clock signal controller 135S may output a signal Vstop for controlling the voltage generator 180G.

To this end, the clock signal controller 135S may include a comparator CMP, an AND gate AND, an internal counter INT CNT, an overcurrent protector OCP, and an output controller CON.

The output controller CON may control the first clock signal generator 135A and the second clock signal generator 136B on the basis of an on clock signal and an off clock signal applied through an on clock signal line ON CLK and an off clock signal line OFF CLK.

The comparator CMP may sense the node voltage of the voltage generator 180G, compare a sensed voltage with an internal reference value, and output a first result value. A first terminal of the comparator CMP may be connected to a node SEN connected a second electrode of the second switch SW and one end of the resistor RS, a second terminal thereof may be connected to a reference voltage terminal REF for providing the internal reference value, and an output terminal thereof may be connected to a first input terminal AN1 of the AND gate AND. The other end of the resistor RS may be connected to a ground terminal which is provided in the clock signal controller 135S (or in the power supply).

The AND gate AND may perform a logic operation (a logic AND operation) on the first result value output from the comparator CMP and a second result value (a count value) output from the internal counter INT CNT, and then, may output a sensing result value. The AND gate AND may include a first input terminal AN1 connected to an output terminal of the comparator CMP and a second input terminal AN2 connected to the internal counter INT CNT. The internal counter INT CNT may provide a pulse (a count value) through a count operation of alternately generating a logic high level and a logic low level at a certain period.

The internal counter INT CNT may perform counting during a period of about 1 ms, and when it is determined that a counting operation performed predetermined times (for example, 64 times) is completed or short circuit between clock signals occurs, the internal counter INT CNT may be initialized.

When it is determined that short circuit between clock signals occurs while monitoring (or counting) a sensing result value output from the AND gate AND for a certain time, the overcurrent protector OCP may output a stop signal Vstop for controlling (stopping) an output of the voltage generator 180G. The overcurrent protector OCP may include an input terminal, connected to an output terminal AN3 of the AND gate AND, and an output terminal connected to the voltage generator 180G. The stop signal Vstop output from the overcurrent protector OCP may be transferred to the signal generator (PWM Gen) included in the voltage generator 180G.

The first clock signal generator 135A and the second clock signal generator 135B may operate based on the on clock signal (On Clk) and the off clock signal (Off Clk) and may respectively output the first clock signal ClkA and the second clock signal ClkB including a logic high level and a logic low level as a level of the gate high voltage Vgh and a level of the gate low voltage Vgl.

The first clock signal generator 135A may include a first pull-up transistor TUA and a first pull-down transistor TDA. The first pull-up transistor TUA may include a gate electrode connected to the output controller CON, a first electrode connected to a gate high voltage terminal VGH, and a second electrode connected to a first output terminal CLKA. The first pull-down transistor TDA may include a gate electrode connected to the output controller CON, a first electrode connected to a gate low voltage terminal VGL, and a second electrode connected to the first output terminal CLKA.

The second clock signal generator 135B may include a second pull-up transistor TUB and a second pull-down transistor TDB. The second pull-up transistor TUB may include a gate electrode connected to the output controller CON, a first electrode connected to the gate high voltage terminal VGH, and a second electrode connected to a second output terminal CLKB. The second pull-down transistor TDB may include a gate electrode connected to the output controller CON, a first electrode connected to the gate low voltage terminal VGL, and a second electrode connected to the second output terminal CLKB.

As illustrated in FIGS. 13 and 14, before short circuit occurs, the AND gate AND may output a logic low (L) result value and a logic high (H) result value on the basis of a result value An1 applied to the first input terminal AN1 and a count value An2 applied to the second input terminal AN2. However, after short circuit occurs, the AND gate AND may output only the logic low (L) result value on the basis of the result value An1 applied to the first input terminal AN1 and the count value An2 applied to the second input terminal AN2.

When a result value output from the AND gate AND is generated to have a logic low level L, the overcurrent protector OCP may define a corresponding time as a short circuit occurrence time. When a logic low level L is continuously generated "N" or more times (where N is an integer of 2 or more) from the short circuit occurrence time, the overcurrent protector OCP may determine the occurrence of short circuit between clock signals, and simultaneously, may output the stop signal Vstop.

When the stop signal Vstop is output from the overcurrent protector OCP, the voltage generator 180G may not output at least one of the first switch signal Sw1 and the second switch signal Sw2 so as to stop an output of the gate high voltage Vgh.

In the above description, when a short circuit occurs, an example where an output of the gate high voltage Vgh stops has been described, but all of the gate low voltage and a voltage causing a problem when short circuit between clock signals occurs may stop.

Moreover, when the continuous occurrence of a short circuit between clock signals is detected (for example, three accumulations), an operation of the power supply 180 (or only a level shifter) for protecting a circuit from an overcurrent may be completely blocked (stopped).

Furthermore, FIG. 14 is merely an example, and a variation of a sensing voltage (a variation of a level), a count scheme, and a count interval (a count period, a frequency, etc.) may be changed.

Figure 15A:
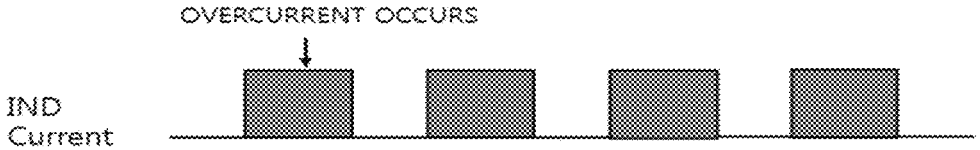

As illustrated in FIG. 15A, in a case where a scope detects a current flowing through an inductor when short circuit between clock signals occurs, an overcurrent may occur in a circuit to which an embodiment is not applied.

Figure 15B:
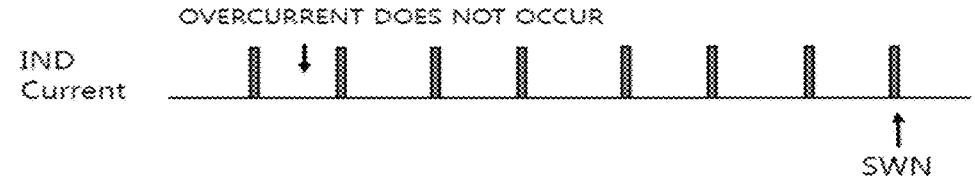

However, as illustrated in FIG. 15B, in a case where a scope detects a current flowing through an inductor when short circuit between clock signals occurs, only switching noise may occur but an overcurrent may not occur in a circuit to which an embodiment is applied. For reference, as a switch stops after the stop signal Vstop is generated, the switching noise SWN may be removed.

Figure 16:
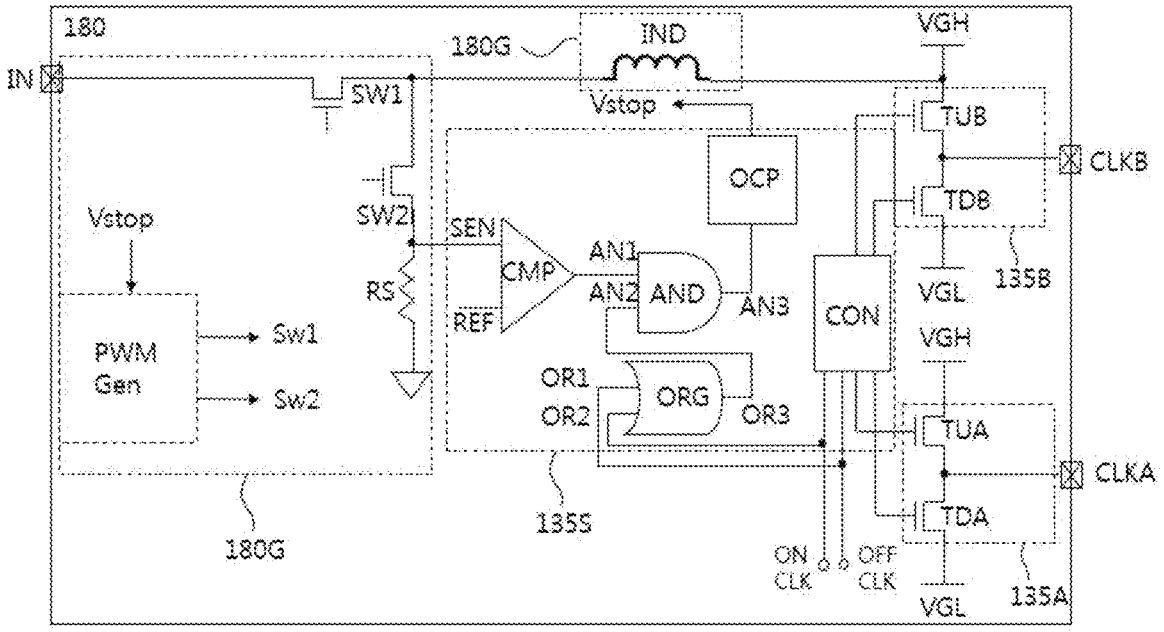
FIG. 16 is a circuit diagram for describing a light emitting display apparatus according to a third embodiment of the present disclosure.
Figure 17:
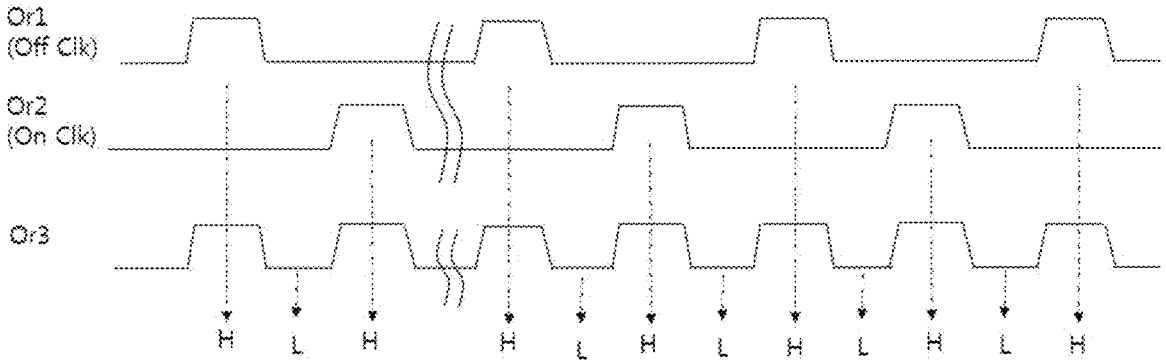
FIGS. 17 to 19 are diagrams for describing a short circuit detection function of the light emitting display apparatus according to the third embodiment of the present disclosure.
Figure 18:
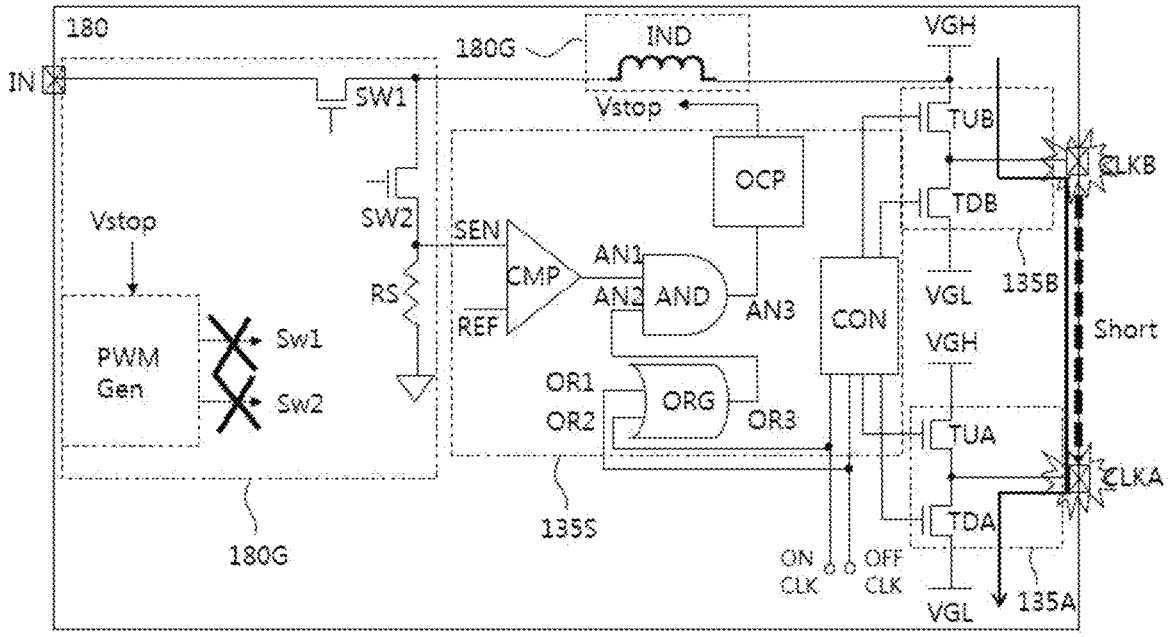
Figure 19:
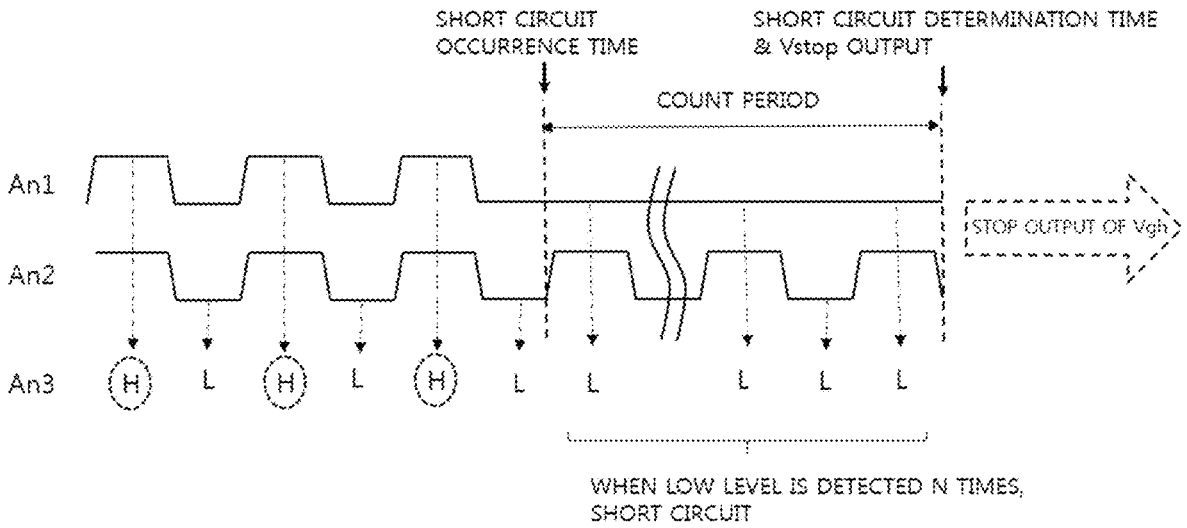

FIG. 16 is a circuit diagram for describing a light emitting display apparatus according to a third embodiment of the present disclosure, and FIGS. 17 to 19 are diagrams for describing a short circuit detection function of the light emitting display apparatus according to the third embodiment of the present disclosure.

Compared to the second embodiment, the third embodiment may have a difference in configuration of a clock signal controller 135S. Therefore, the difference will be mainly described below, and the descriptions of the second embodiment may be applied to the other elements.

As illustrated in FIG. 16, a level shifter 135 may include a first clock signal generator 135A, a second clock signal generator 135B, and a clock signal controller 135S.

The clock signal controller 135S may control the first clock signal generator 135A and the second clock signal generator 135B. Also, the clock signal controller 135S may sense a node voltage of a voltage generator 180G, and when short circuit occurring between clock signals is detected based on a sensed voltage and an internal reference value, the clock signal controller 135S may output a signal Vstop for controlling the voltage generator 180G.

To this end, the clock signal controller 135S may include a comparator CMP, an AND gate AND, an OR gate ORG, an overcurrent protector OCP, and an output controller CON.

The OR gate ORG may include a first input terminal OR1 connected to an off clock signal line OFF CLK, a second input terminal OR2 connected to an on clock signal line ON CLK, and an output terminal OR3 connected to a second input terminal AN2 of the AND gate AND. The OR gate ORG may perform a logic operation (a logic OR operation) on an off clock signal and an on clock signal to output a second result value. The OR gate ORG may provide a pulse where a logic high level and a logic low level are alternately repeated, on the basis of the off clock signal and the on clock signal. In this manner, when the pulse where a logic high level and a logic low level are alternately repeated is provided based on the off clock signal and the on clock signal, a separate counter may not be added, and thus, the complexity of an apparatus may be reduced (the simplification of a configuration).

The AND gate AND may perform a logic operation (a logic AND operation) on a first result value output from the comparator CMP and the second result value output from the OR gate ORG to output a sensing result value. The AND gate AND may include a first input terminal AN1 connected to an output terminal of the comparator CMP and a second input terminal AN2 connected to the output terminal of the OR gate ORG.

When it is determined that short circuit between clock signals occurs while monitoring (or counting) a sensing result value output from the AND gate AND for a certain time, the overcurrent protector OCP may output a stop signal Vstop for controlling (stopping) an output of the voltage generator 180G. The overcurrent protector OCP may include an input terminal, connected to an output terminal AN3 of the AND gate AND, and an output terminal connected to the voltage generator 180G. The stop signal Vstop output from the overcurrent protector OCP may be transferred to a signal generator (PWM Gen) included in the voltage generator 180G.

As illustrated in FIGS. 16 and 17, a logic high level of a pulse corresponding to an on clock signal (On Clk) applied through an off clock signal line OFF CLK may not overlap a logic high level of a pulse corresponding to an off clock signal (Off Clk) applied through an on clock signal line ON CLK. Therefore, like a flow of a signal output through a counter, the OR gate ORG may output a signal having a logic high level H and a logic low level L which are continuously and alternately repeated.

As illustrated in FIGS. 18 and 19, before short circuit occurs, the AND gate AND may output a logic low (L) result value and a logic high (H) result value on the basis of a result value An1 applied to the first input terminal AN1 and a count value An2 applied to the second input terminal AN2. However, after short circuit occurs, the AND gate AND may output only the logic low (L) result value on the basis of the result value An1 applied to the first input terminal AN1 and the count value An2 applied to the second input terminal AN2.

When a result value output from the AND gate AND is generated to have a logic low level L, the overcurrent protector OCP may define a corresponding time as a short circuit occurrence time. When a logic low level L is continuously generated "N" or more times (where N is an integer of 2 or more) from the short circuit occurrence time, the overcurrent protector OCP may determine the occurrence of short circuit between clock signals, and simultaneously, may output the stop signal Vstop.

When the stop signal Vstop is output from the overcurrent protector OCP, the voltage generator 180G may not output (an off signal or floating) at least one of a first switch signal Sw1 and a second switch signal Sw2 so as to stop an output of the gate high voltage Vgh.

However, when a logic low level L is not continuously generated "N" or more times (where N is an integer of 2 or more) from the short circuit occurrence time, a temporary operation error may be determined (a stop signal is not output). As a result, a switching operation of the voltage generator 180G may maintain a normal state, and thus, the occurrence of an abnormal operation may be prevented (may enhance the performance of determining short circuit and may reduce a probability of an abnormal operation).

As described above, according to the present disclosure, the occurrence or lack of occurrence of a short circuit between clock signals overlapping one another for a relatively short time may be detected, and an output of a gate voltage may stop based on a detection result, thereby preventing or at least reducing the damage of a circuit caused by an overcurrent or preventing or at least reducing the occurrence of fire caused by the damage. Also, the present disclosure may easily detect the occurrence or lack of occurrence of a short circuit between clock signals on the basis of a sensing scheme and a logic operation scheme to prevent an abnormal operation, thereby enhancing the reliability and stability of an apparatus.

The effects according to the present disclosure are not limited to the above examples, and other various effects may be included in the specification.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. A display apparatus comprising:

a display panel configured to display an image;

a shift register configured to supply a scan signal to the display panel;

a level shifter configured to output clock signals for driving the shift register;

a power supply configured to supply a gate voltage to the level shifter; and a controller configured to sense a node voltage of a circuit generating the gate voltage that is indicative of a magnitude of the gate voltage, detect a short circuit between the clock signals based on the sensed node voltage and an internal reference value, and control the power supply when the short circuit occurs between the clock signals.

2. The display apparatus of claim 1, wherein, the power supply stops an output of the gate voltage when the short circuit occurs between the clock signals.

3. The display apparatus of claim 1, wherein the controller performs a logic operation on a first result value generated by comparing the sensed node voltage with the internal reference value, and a second result value generated through a count operation of an internal counter to generate a sensing result value and monitors the sensing result value for a certain time to determine whether the short circuit occurs between the clock signals.

4. The display apparatus of claim 1, wherein the controller comprises:

a comparator including a first terminal connected to a node of the circuit generating the gate voltage, and a second terminal connected to a reference voltage terminal providing the internal reference value;

an AND logic gate including a first input terminal, connected to an output terminal of the comparator, and a second input terminal connected to an output terminal of an internal counter; and an overcurrent protector connected to an output terminal of the AND logic gate to determine whether the short circuit occurs between the clock signals while monitoring a sensing result value output from the AND logic gate for a certain time, and when the short circuit is determined, to output a stop signal for stopping an output of the power supply.

5. The display apparatus of claim 4, wherein the overcurrent protector monitors a sensing result value output from the AND logic gate for a certain time, and when a specific logic signal is continuously generated, the overcurrent protector determines the short circuit between the clock signals.

6. The display apparatus of claim 1, wherein the level shifter operates based on an off clock signal and an on clock signal each output from a timing controller to output the clock signals, and the controller performs a logic operation on a first result value generated by comparing the sensed node voltage with the internal reference value, and a second result value generated based on the off clock signal and the on clock signal to generate a sensing result value and monitors the sensing result value for a certain time to determine whether the short circuit occurs between the clock signals.

7. The display apparatus of claim 1, wherein the controller comprises:

a comparator including a first terminal connected to a node of the circuit generating the gate voltage, and a second terminal connected to a reference voltage terminal providing the internal reference value;

an OR logic gate including a first input terminal connected to an off clock signal line for controlling the level shifter, and a second input terminal connected to an on clock signal line for controlling the level shifter;

an AND logic gate including a first input terminal connected to an output terminal of the comparator, and a second input terminal connected to an output terminal of the OR logic gate; and an overcurrent protector connected to an output terminal of the AND logic gate to determine whether the short circuit occurs between the clock signals while monitoring a sensing result value output from the AND logic gate for a certain time, and when the short circuit is determined, to output a stop signal for stopping an output of the power supply.

8. The display apparatus of claim 7, wherein the overcurrent protector monitors a sensing result value output from the AND logic gate for a certain time, and when a specific logic signal is continuously generated, the overcurrent protector determines the short circuit between the clock signals.

9. A display apparatus comprising:

a display panel configured to display an image;

a shift register configured to supply a scan signal to the display panel;

a level shifter configured to output clock signals for driving the shift register;

a power supply configured to supply a gate voltage to the level shifter; and a controller configured to stop an output of the power supply when a specific logic signal that is based on a magnitude of the gate voltage is continuously generated "N" or more times in a circuit provided therein due to a short circuit occurs between the clock signals, where N is an integer of 2 or more.

10. The display apparatus of claim 9, wherein the controller senses a node voltage of a circuit generating the gate voltage where the node voltage is indicative of the magnitude of the gate voltage and performs an arithmetic operation of detecting whether the short circuit occurs between the clock signals the sensed node voltage and an internal reference value, and when the specific logic signal is continuously generated "N" or more times, the controller stops an output of the power supply, where N is an integer of 2 or more.

11. The display apparatus of claim 9, wherein, when the short circuit between the clock signals is determined by the controller, the power supply stops the output of the power supply.

12. A power supply comprising:

a level shifter, when a specific logic signal is continuously generated "N" or more times in a circuit provided therein due to a short circuit occurring between clock signals, the level shifter configured to determine the short circuit occurs between the clock signals and output a stop signal, where N is an integer of 2 or more; and a voltage generator configured to stop a switching operation of generating a gate voltage that is supplied to the level shifter on a basis of the stop signal output from the level shifter, wherein the specific logic signal is based on a magnitude of the gate voltage generated by the voltage generator.

13. The power supply of claim 12, wherein the level shifter comprises a controller configured to sense a node voltage of a circuit generating the gate voltage in the voltage generator that is indicative of the magnitude of the gate voltage and perform an arithmetic operation of detecting whether the short circuit occurs between the clock signals on a basis of the sensed node voltage and an internal reference value, and when the specific logic signal is continuously generated "N" or more times, determine the short circuit between the clock signals, where N is an integer of 2 or more.

* * * * *